United States Patent [19]

Gaule et al.

[11] 4,215,738

[45] Aug. 5, 1980

[54] ANTI-PARALLEL INDUCTORS FOR SHAPE CONTROL IN ELECTROMAGNETIC CASTING

[75] Inventors: Gerhard K. Gaule, Elberon, N.J.; John C. Yarwood, Madison; Derek E. Tyler, Cheshire, both of Conn.

[73] Assignee: Olin Corporation, New Haven, Conn.

[21] Appl. No.: 25,493

[22] Filed: Mar. 30, 1979

[51] Int. Cl.[3] ..... B22D 11/01; B22D 27/02

[52] U.S. Cl. ..... 164/49; 164/147; 164/250

[58] Field of Search ..... 164/82, 147, 49, 250, 164/251

[56] References Cited

U.S. PATENT DOCUMENTS

| | | | |
|---|---|---|---|
| 3,605,865 | 9/1971 | Getselev | 164/250 |
| 3,702,155 | 11/1972 | Getselev | 164/49 X |
| 3,985,179 | 10/1976 | Goodrich et al. | 164/250 |
| 4,004,631 | 1/1977 | Goodrich et al. | 164/250 |

FOREIGN PATENT DOCUMENTS

| | | | |
|---|---|---|---|
| 738908 | 7/1966 | Canada | 164/147 |
| 930925 | 7/1973 | Canada | 164/250 |
| 422523 | 9/1974 | U.S.S.R. | 164/147 |
| 503626 | 3/1976 | U.S.S.R. | 164/49 |

OTHER PUBLICATIONS

Jehn, Hermann, et al. "Electromagnetic Ingot Molds. I. Theoretical Treatment", *Z. Metallk*, 68(6), 1977, pp. 397–409.

*Primary Examiner*—Robert D. Baldwin
*Assistant Examiner*—Gus T. Hampilos
*Attorney, Agent, or Firm*—Victor A. DiPalma; Paul Weinstein

[57] ABSTRACT

A method and apparatus for electromagnetic casting of metals and alloys is disclosed wherein anti-parallel inductors are utilized between the main inductor and the ingot being cast to provide for shape control of the ingot.

11 Claims, 6 Drawing Figures

ANTI-PARALLEL INDUCTORS FOR SHAPE CONTROL IN ELECTROMAGNETIC CASTING

BACKGROUND OF THE INVENTION

It is known in the art that electromagnetically cast ingots exhibit surface perterbations that are detrimental during subsequent processing and which are also detrimental in recovery achieved thereby. These surface defects most often take the form of longitudinal pleats or standing waves that set up within the contained molten metal during the electromagnetic casting process. Such defects are particularly relevant in the region adjacent to the electrical connections of the inductor. Discussions of such surface defects can be found in Canadian Pat. No. 930,925 to Getselev, and U.S. Pat. No. 3,702,155 to Getselev.

It is also known from the prior art that electromagnetically cast rectangular ingots are often cast with high radius of curvature ends which is indicative of the need for improved shape control at the corners of such ingots. Reference is made to our copending U.S. application, Ser. No. 1,730, filed January 8, 1979 and entitled "Ingot Shape Control By Dynamic Head in Electromagnetic Casting", which disclosure is hereby incorporated by reference.

In U.S. Pat. No. 3,605,865 to Getselev a non-magnetic screen is utilized to properly shape the magnetic field for containing the molten metal being electromagnetically cast. In addition to screen utilization, solution of the problem of ingot shape may be sought through electromagnetic field modification, utilizing shaped inductors (U.S. Pat. 4,004,631 to Goodrich et al.) or by utilizing both screens and shaped inductors (U.S. Pat. No. 3,985,179 to Goodrich et al.).

Other means of enhancing and controlling ingot shape is by utilization of a hot-top or open-ended container placed before and adjacent to the electromagnetic casting station, as depicted in copending U.S. Ser. No. 876,912 filed Feb. 13, 1978 and entitled "Improved Process for Electromagnetic Casting of Copper and Copper Base Alloys", which is a continuation in part of U.S. Ser. No. 752,458 filed Dec. 20, 1976, now abandoned.

A general discussion of the use of conductor pairs and grids to provide electromagnetic forces useful in the shape control of metal castings appears in the article "Electromagnetic Ingots Molds. I. Theoretical Treatment", Z. Metallk (1977) by Hermann Jehn, Eckehard Fromm and Preter Neuschutz, pp. 397–409.

SUMMARY OF THE INVENTION

The present invention comprises a process and apparatus for electromagnetic casting of metals and alloys utilizing anti-parallel inductors which are placed between the main inductor and the ingot being cast. The use of such antiparallel inductors provides improved shape control of the ingot being cast as a result of the high density magnetic field emanating therefrom.

Excellent means of maintaining uniform shape control in contained molten metal during an electromagnetic casting process is provided by specifically arranging anti-parallel grid inductors which possess a short range magnetic field between the molten metal being cast and the main inductor.

High density magnetic field control is also achieved through the use of anti-parallel pairs of inductors, or pancake coils which are also placed between the main inductor and the molten metal being cast.

It is an object of the present invention to provide a process and apparatus for substantially eliminating surface defects such as longitudinal pleats or standing waves on the surface of the electromagnetically cast ingots. It is another object of the present invention to provide an electromagnetic field casting apparatus and process which provides an excellent means of maintaining uniformed shape control in molten metal head. It is a further object of the present invention to provide an electromagnetic field casting process and apparatus which is particularly applicable to maintaining the shape of the major sides of retangular electromagnetically cast ingots. It is yet a further object of the present invention to provide an improved electromagnetic field casting process and apparatus which provides enhanced shape control at the corners of ingots or adjacent to the location of the electrical connections from the bus bars to main single turn inductors utilized in the electromagnetic casting process.

Further objects and advantages of the present invention will become more apparent from the consideration of the following specification.

DETAILED DESCRIPTION OF THE PREFERRED EMBODIMENTS

Figure 1:
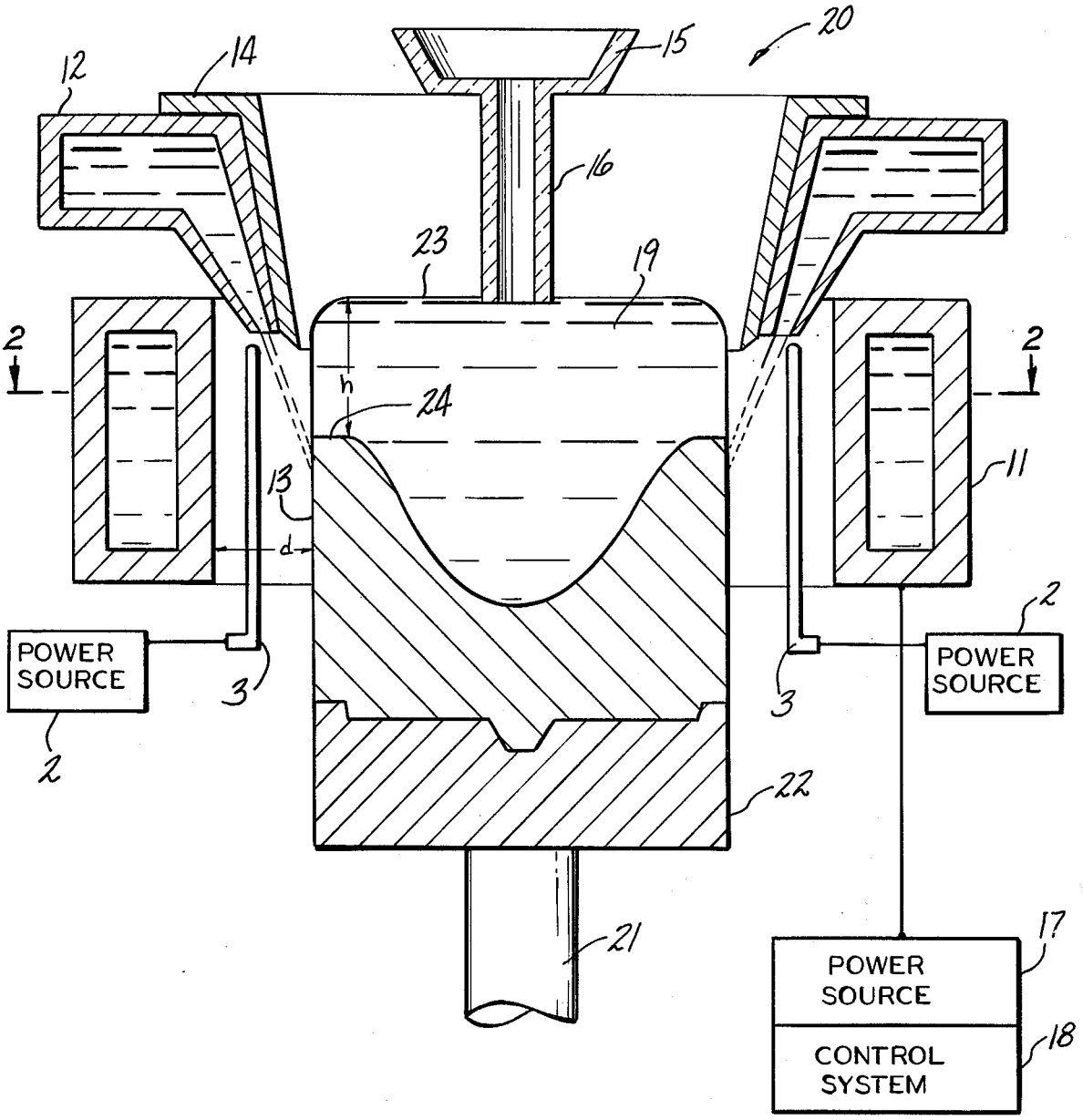
FIG. 1 is a schematic representation of an electromagnetic casting apparatus in accordance with this invention showing anti-parallel inductors or grids in position between the main inductor and the molten metal ingot.

Referring now to FIG. 1 there is shown therein one embodiment of an electromagnetic casting apparatus 20 in accordance with this invention, consisting in part of a single turn inductor 11 and anti-parallel grids 3. The electromagnetic casting apparatus 20 is comprised of a single turn inductor 11 which is water cooled; multiple antiparallel grids 3; a cooling manifold 12 for applying cooling water to the peripheral surface 13 of the metal being cast; and a non-magnetic screen 14. Molten metal is continuously introduced into the mold 20 during a casting run using a trough 15 and a downspout 16, with the initial surge of molten metal contacting bottom block 22 in a raised position after which bottom block 22 is withdrawn from ram 21. The inductor 11 is excited by an alternating current from a power source 17 and control system 18. The alternating current in the inductor 11 produces a magnetic field which interacts with the molten metal head 19 to produce eddy currents therein. Head 19 has a depth h which measures from top surface 23 to solidification front 24. These eddy currents in turn interact with the magnetic field and produce forces which apply a magnetic pressure to the molten metal head 19 to contain it so that it solidifies in a desired ingot cross section. An air gap d exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot cross section. The purpose of the non-magnetic screen 14 is to fine tune and balance the magnetic pressure with the hydrostatic pressure of the molten metal head 19. Antiparallel grids 3 are attached to power source 2 and orthogonally with respect to the main containment inductor turn or turns and are specifically located about the periphery of the forming ingot to provide additional shape control or fine tuning.

Figure 2:
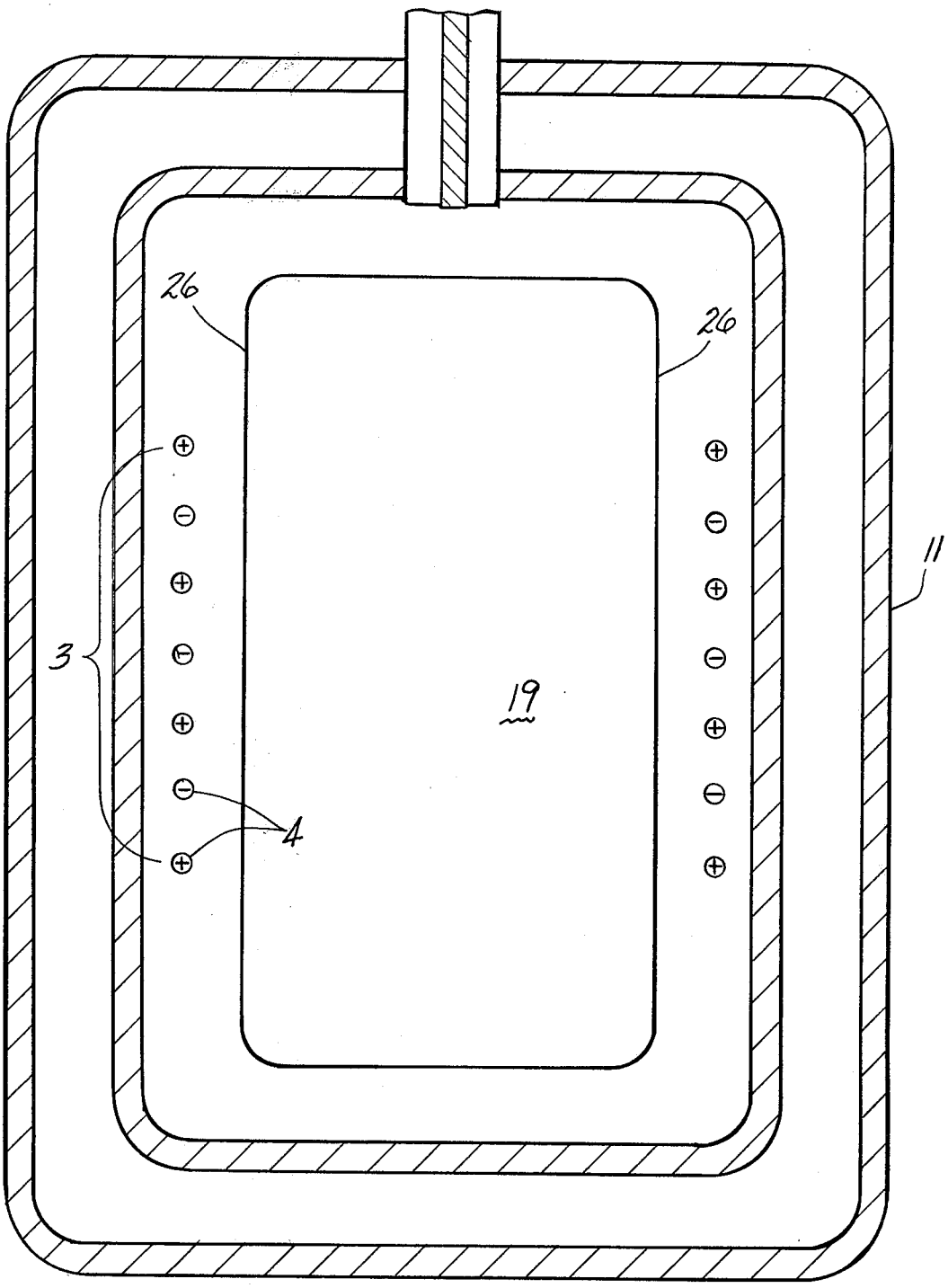
FIG. 2 is a plan view taken along the line 2—2 of FIG. 1 showing the ingot section, the main inductor and the anti-parallel inductor or grids positioned therebetween.
Figure 6:
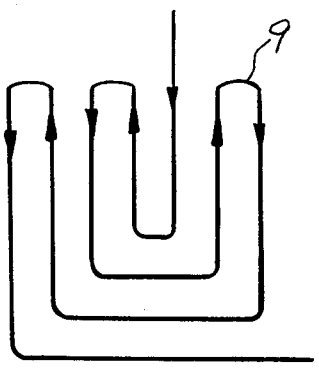
FIG. 6 is a view of a somewhat larger pancake coil which might be utilized for example as the anti-parallel inductor grid of FIG. 2.

Referring to FIG. 2, in accordance with one embodiment of this invention, orthogonal anti-parallel grids 3 are placed along the broad faces 26 of metal ingot 19 between the metal ingot 19 and the main inductor 11. Anti-parallel grids 3 may comprise one or a plurality of pairs of coils 4 and might typically be construed of pancake coils or grid 9 depicted in FIG. 6.

In accordance with this invention, the enhanced shape control supplied by these inductors or anti-parallel grids 3 can be preferably applied to that liquid adjacent to the solidification front where shape control is of paramount importance. Accordingly, the anti-parallel grids can be located inside the main inductor but below any non-magnetic shield that may be required for shape control, adjacent to the liquid metal meniscus. Anti-parallel grids or pairs are preferably disposed orthogonally with respect to the main containment inductor turns. It is to be emphasized that any number of grids 3 can be utilized as requried for enhanced shape control.

Figure 3:
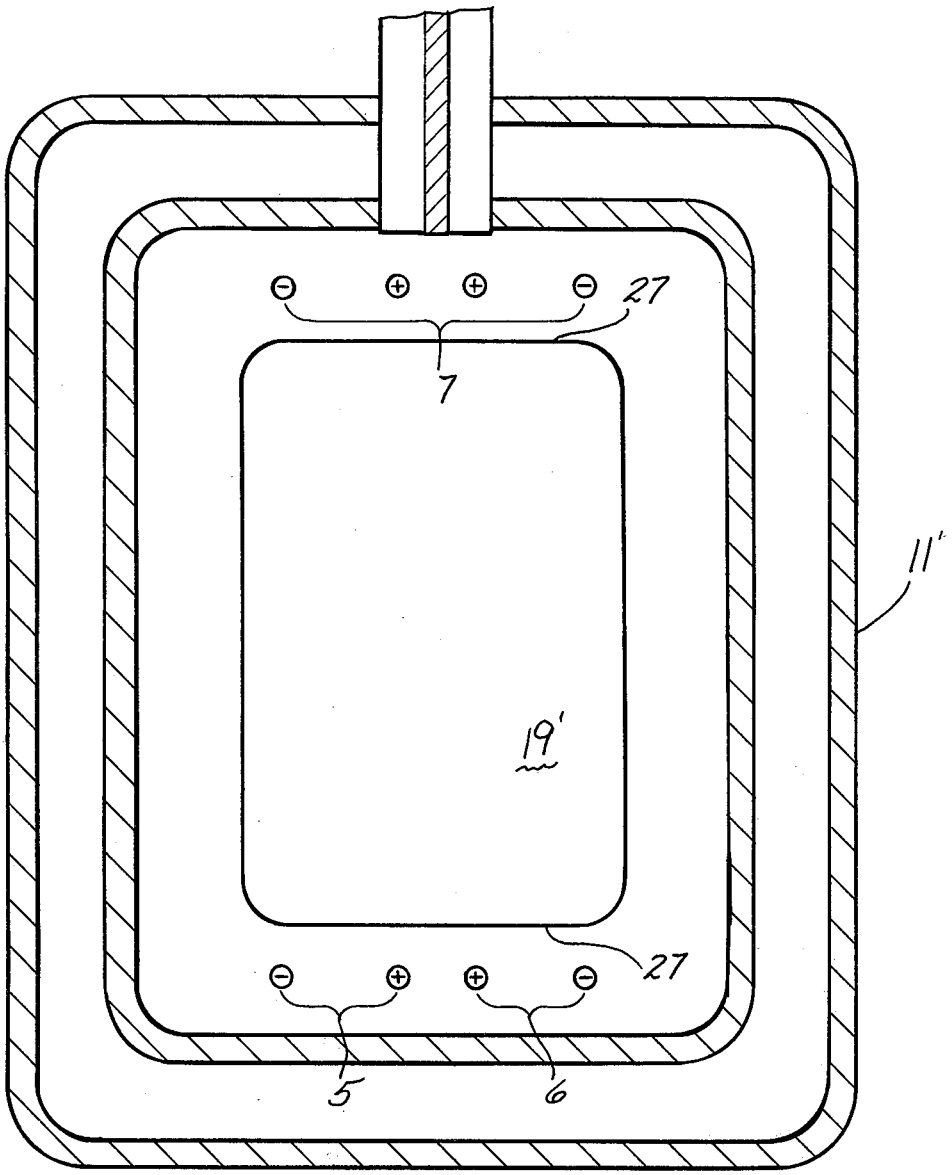
FIG. 3 is a plan view of an ingot section and a main inductor showing orthogonal pairs of anti-parallel or pancake coils located therebetween.

FIG. 3 shows a second embodiment of a rectangular ingot cross section showing orthogonal anti-parallel pairs 5, 6 disposed at the narrow faces 27 of the rectangular ingot 19 to provide additional shape control. Anti-parallel orthogonal pairs 5 and 6 of FIG. 3 could typically be comprised of standard pancake coils such as for example, pancake coil 7 of FIG. 5. As in the embodiment of FIG. 2 anti-parallel orthogonal pairs 5 and 6 are located between the ingot being cast 19' and the main inductor 11'.

Figure 4:
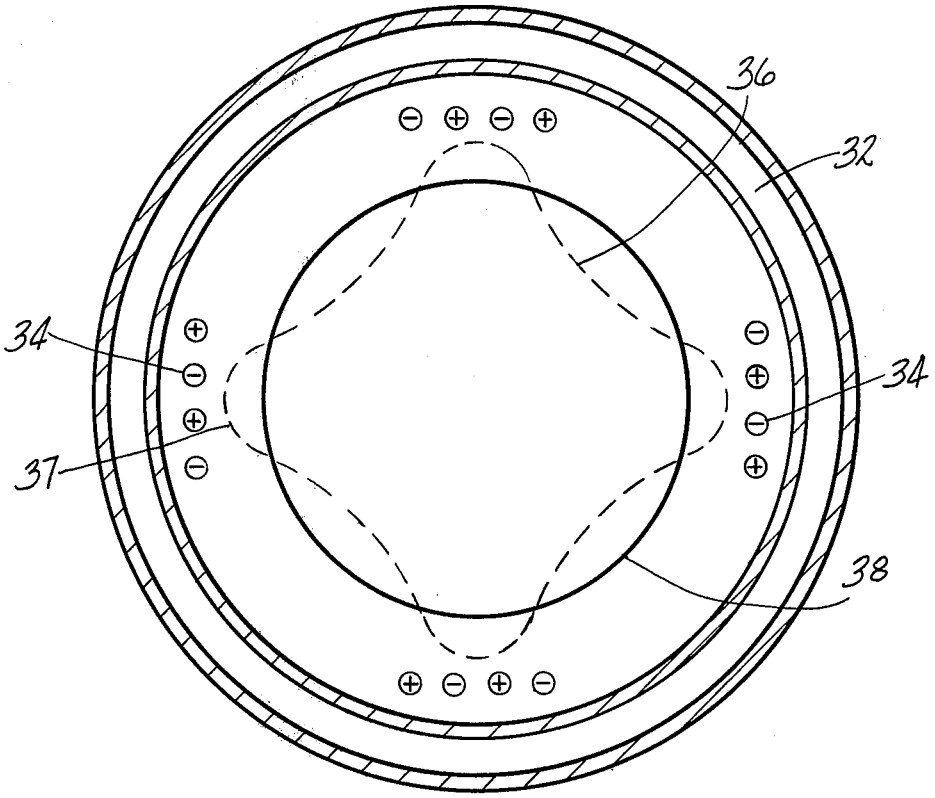
FIG. 4 is a top view of a cylindrical ingot and a cylindrical main inductor showing surface defects in the form of standing waves along the surface of the ingot and showing anti-parallel grids specifically located to counteract the said standing wave pattern.

FIG. 4 depicts a cylindrical ingot being cast with a standing wave shape associated with electromagnetic casting processes being shown by dotted line 36. The standing wave shape depicted by dotted line 36 has been exaggerated for additional clarity. The standing wave comprises peaks 37 which it is desired to control and flatten so as to form a substantially cylindrical ingot 38. Peaks 37 are subjected to additional current provided by anti-parallel grids 34 which act to subject peaks 37 to an additional force to thereby flatten and round out the cylindrical ingot.

Figure 5:
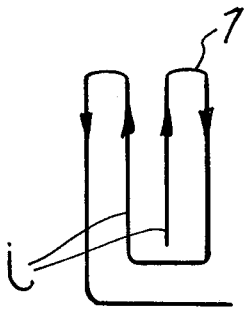
FIG. 5 is a view of a pancake coil which might be used for example in the embodiment depicted in FIG. 3.

A somewhat greater flattening effect could be obtained with respect to peaks 37 by utilizing the pancake coil depicted in FIG. 5. The innermost wires i of pancake coil 7 pass current in the same direction bringing about a somewhat higher density magnetic field than that obtained by grids 34.

It is within the contemplation of this invention that any number of grids or pancake coils can be utilized in conjunction with ingots of any cross section. Thus more than one grid can be placed between an ingot face and the main inductor and grids could be placed between any one or all of the ingot faces and the main inductor, as desired.

The process of this invention enables one to determine either by experiment or in the course of an electromagnetic casting run where peaks or undesirable shapes exist, enabling the placement of anti-parallel grids in close proximity to those areas which contain peaks or protrusions which it is desired to either flatten or form into some other preferred shapes.

It must be emphasized that the anti-parallel inductors or pancake coils of this invention should preferably be operated at a different frequency than the main inductor in order to prevent interference between the fields. Most preferably, the fine tuning coils should operate at a higher frequency than the main containment inductor. The selected higher frequency should not be a small multiple of the main inductor frequency, to avoid interaction between the fields due to harmonic effects.

Since most support is provided by the main containment inductor and only small modifying forces are to be provided by the tuning coils, current densities of the order to 10 percent of those used in the main inductor are typically suitable for the tuning coils.

The anti-parallel grids or pairs of this invention need not be separate from the main inductor and it is contemplated that anti-parallel grids or pairs could be incorporated into and insulated from the body of the main inductor. This embodiment would find particular use where it would be desired to avoid possible interference with cooling water patterns.

In accordance with this invention, it is now possible to provide fine tuning or shape control of an electromagnetically cast ingot by determining where undesirable surface undulations exist and by placing anti-parallel grids or pairs in the appropriate position about the periphery of the cast ingot. This easy provision of a controlled greater current at specific portions of the periphery of an ingot enhances the shape control of the ingot and allows for ready adjustment thereof.

It is clear that in accordance with this invention additional balance can be provided to the three forces normally acting on an electromagnetically cast ingot. The forces of the electromagnetic field, the dynamic forces associated with the molten metal, and the metallostatic forces can now be counter balanced to a certain extent along the areas of the ingot by easy provision of a current or additional currents provided at 90° to the currents provided by the primary inductor, that is longitudinally of the ingot being cast. These additional currents can be utilized to smooth out any standing wave effects as well as any other surface imperfections which are inherent in other electromagnetic casting processes.

All patents and applications described above are intended to be incorporated by reference herein.

It is apparent that there has been provided with this invention novel means for fine tuning electromagnetically cast ingot surfaces which fully satisfy the objects, means and advantages set forth hereinbefore. While the invention has been described in combination with specific embodiments thereof, it is evident that many alternatives, modifications and varations will be apparent to those skilled in the art in light of the foregoing description. Accordingly, it is intended to embrace all such alternatives, modifications and variations as fall within the spirit and broad scope of the appended claims.

What is claimed is:

1. A process for obtaining fine shape control during electromagnetic coating of molten metal or alloy into an ingot of desired shape comprising:

establishing a molten metal casting zone;

providing a main inductor in surrounding relation to said zone;

placing at least one anti-parallel inductor pair between said main inductor and said casting zone;

passing a current through said main inductor to generate a first primary electromagnetic field in said casting zone;

passing a lesser current through said at least one anti-parallel inductor pair to generate a second electromagnetic field in said casting zone; and pouring said molten metal or alloy into said casting zone.

2. A process as in claim 1 including the steps of determining the surface areas of the forming ingot having standing wave portions or high points, and placing said at least one anti-parallel inductor between said main inductor and said portions.

3. A process as in claim 1 wherein said ingot is rectangular and said anti-parallel inductors are placed along the broad faces of said ingot.

4. A process as in claim 1 wherein said ingot is rectangular and said anti-parallel inductors are placed along the narrow faces of said ingot.

5. A process as in claim 2 wherein said ingot is cylindrical and said anti-parallel inductors are placed along the portions thereof having peak standing waves of molten metal thereon.

6. A process as in claim 1 wherein said ingot is rectangular and said anti-parallel inductors are placed along all faces of said ingot.

7. In an apparatus for electromagnetically casting molten metals or alloys into a product of desired shape comprising:

means for receiving and electromagnetically casting said molten metals or alloys into said product, the improvement wherein:

said means for receiving and electromagnetically casting said molten metal comprises in combination at least one anti-parallel inductor pair and a main inductor, said anti-parallel inductor pair being located within the casting zone formed by said main inductor.

8. An apparatus as in claim 7 wherein said at least one anti-parallel inductor comprises a grid structure whose primary elements are disposed orthogonally with respect to the turns of said main inductor.

9. An apparatus as in claim 8 wherein said grid structure comprises a pancake coil.

10. An apparatus as in claim 8 wherein said grid structure is made up of pairs of anti-parallel coils or wires.

11. An apparatus as in claim 8 wherein said grid structure comprises at least four primary elements and wherein the two innermost elements of said grid structure conduct current in the same direction.

* * * * *

UNITED STATES PATENT AND TRADEMARK OFFICE

CERTIFICATE OF CORRECTION

PATENT NO. : 4,215,738

DATED : August 5, 1980

INVENTOR(S) : Gerhart K. Gaule, John C. Yarwood and Derek E. Tyler

It is certified that error appears in the above-identified patent and that said Letters Patent is hereby corrected as shown below:

In the cover page, line 6, "Gerhard K. Gaule" should read --Gerhart K. Gaule--.

In column 1, line 7, "perterbations" should read --perturbations--.

In column 2, line 14, "retangular" should read --rectangular--;

In column 2, line 58, "antiparallel" should read --anti-parallel--;

In column 3, line 17, "Antiparallel" should read --Anti-parallel--.

In column 4, line 66, "varations" should read --variations--.

In column 5, line 5, "coating" should read --casting--.

Signed and Sealed this

*Twenty-second* Day of *February 1983*

[SEAL]

*Attest:*

GERALD J. MOSSINGHOFF

*Attesting Officer*

*Commissioner of Patents and Trademarks*